United States Patent [19]

Sekozawa et al.

[11] Patent Number: 4,667,640

[45] Date of Patent: May 26, 1987

[54] METHOD FOR CONTROLLING FUEL INJECTION FOR ENGINE

[75] Inventors: Teruji Sekozawa, Kawasaki; Motohisa Funabashi, Sagamihara; Makoto Shioya, Tokyo; Michihiko Onari, Kokubunji; Hiroatsu Tokuda, Katsuta, all of Japan

[73] Assignee: Hitachi, Ltd., Tokyo, Japan

[21] Appl. No.: 696,480

[22] Filed: Jan. 30, 1985

[30] Foreign Application Priority Data

Feb. 1, 1984 [JP] Japan ..... 59-15172
Feb. 10, 1984 [JP] Japan ..... 59-21686

[51] Int. Cl.[4] ..... F02B 3/00
[52] U.S. Cl. ..... 123/492; 123/480
[58] Field of Search ..... 123/492, 478, 480, 493, 123/491

[56] References Cited

U.S. PATENT DOCUMENTS 4,357,923 11/1982 Hideg ..... 123/492
4,359,993 11/1982 Carlson ..... 123/492
4,388,906 6/1983 Sugiyama ..... 123/492

*Primary Examiner*—Ronald B. Cox
*Attorney, Agent, or Firm*—Antonelli, Terry & Wands

[57] ABSTRACT

Disclosed is a method for controlling fuel injection for an engine, in which, on the basis of a phenomenon that a part of fuel vaporized from a liquid film adhering to a wall surface of a fuel intake manifold remains in the intake manifold in the form of vapor fuel, the quantity of liquid film and the quantity of vapor fuel are estimated by using control parameters such as air mass flowing through a throttle valve, throttle opening, engine speed, air fuel ratio, etc.; the quantity of liquid film and the quantity of vapor fuel at a desired point of time are predicted on the basis of the result of estimation; and the quantity of fuel injection is controlled so as to make the air fuel ratio be a desired air fuel ratio. Further, the quantity of liquid film is estimated in the case where the data as to the air fuel ratio obtained by an $O_2$ sensor includes an observation delay; a sum of the quantity of fuel vaporized from a liquid film at a desired point of time and the quantity of fuel which does not adhere to a wall surface of an intake manifold is predicted on the basis of the result of the estimation; and the quantity of fuel injection is controlled so as to make the observed air fuel ratio be a desired air fuel ratio on the assumption that the quantity of fuel corresponding to the estimated sum is sucked into a cylinder.

5 Claims, 8 Drawing Figures

METHOD FOR CONTROLLING FUEL INJECTION FOR ENGINE

FIELD OF THE INVENTION

The present invention relates to a method for controlling fuel injection for an engine and particularly to a method for controlling fuel injection suitable for such an engine of the fuel injection type in which a mixture of air and fuel is fed into a cylinder through an intake manifold.

BACKGROUND OF THE INVENTION

As fuel injection control, conventionally, there has been proposed a feedback control system in which a basic fuel injection quantity is calculated on the basis of an air flow rate obtained from an air flow meter and an oxygen quantity remaining in an exhaust gas is detected by an $O_2$ sensor so as to correct a fuel quantity to have a desired air fuel ratio with which a three-way catalyst may acts most effectively for purifying the exhaust gas. Further, a function to increase fuel in an accelerating operation has been provided to control the air fuel ratio to be a theoretical value (for example, reference is made to "ENGINE CONTROL", Journal of the Institute of Electrical Engineering of Japan, Vol. 101, No. 12, or "Recent Electronics Car", Journal of the Society of Instrument and Control Engineers, Vol. 21, No. 7). According to such a conventional system, however, it becomes impossible to satisfy the control performance by feedback correction effected through an $O_2$ sensor, especially in a rapidly accelerating operation, so that the amount of NOx remains large. The main reason for this is that there occur a flow delay of exhaust gas in an exhaust pipe, a time delay in the steps effected in the engine until an exhaust gas is produced, etc., and feedback is effected by observing such phenomena. Alternatively, there has been proposed a method in which correction was made by increasing fuel in rapid acceleration to make the air fuel ratio be a theoretical value. In this method, however, there has been a problem that, even though a desired air fuel ratio could be obtained during acceleration, the fuel quantity became too large after the completion of acceleration so that the exhaust gas might include HC and/or CO because the conversion rate of the three way catalyst with respect to HC and CO (the respective rate with which CO or HC is oxidized to $CO_2$ or $H_2O$ or with which NOx is reduced to $N_2$) was lowered. This was mainly caused by the fact that part of the fuel injected into an intake manifold and adhering to a wall surface of the intake manifold, or the adhered fuel (hereinafter referred to as a "liquid film") was evaporated and sucked into a cylinder together with injected fuel, so that there occurred a disadvantage that the air fuel ratio could not always be kept at a desired air fuel value.

SUMMARY OF THE INVENTION

An object of the present invention is to provide a method for controlling fuel injection in which, taking into consideration a dynamic characteristic of a fuel system and flow delay in an exhaust pipe, a fuel quantity adhering to a wall surface of an intake manifold is predicted and a fuel injection quantity is determined on the basis of the predicted fuel quantity so as to make an air fuel ratio be a desired air fuel ratio.

An unstable dynamic characteristic of a fuel system in an intake manifold is caused by the fact that part of the fuel injected into the intake manifold adheres on a wall surface of the intake manifold or the liquid film is evaporated and sucked into a cylinder together with the injected fuel. However, not all the evaporated fuel is sucked into the cylinder, but a part thereof remains in the intake manifold as fuel in the form of vapor (hereinafter referred to as "vapor fuel"). According to the present invention, this phenomenon is utilized and a fuel quantity is controlled so as to make the air fuel ratio a theoretical value. That is, the present invention has a first feature that a liquid film quantity and a vapor fuel quantity, which are important factors for determining the fuel dynamic characteristic, are estimated on the basis of an the air mass flowing in a throttle portion, throttle opening, pressure value in an intake manifold, water temperature, engine speed, and air fuel ratio; the liquid film quantity and vapor fuel quantity at a desired point of time are predicted on the basis of the result of the estimation; and a fuel injection quantity is controlled so as to make the air fuel ratio a theoretical value on the basis of the result of the prediction. Further, to cope with the problem that the air fuel ratio can not kept at a theoretical value due to the fact that not all the injected fuel can be sucked into a cylinder, the present invention has a second feature that a liquid film is calculated so as to determine the fuel injection quantity which is an operation quantity to make the air fuel ratio be a theoretical value on the assumption that the quantity of fuel sucked into a cylinder is a sum of the quantity of a part of injected fuel which does not adhere on the wall surface of an intake manifold and the quantity of fuel evaporated from a liquid film. However, there is a problem that in calculating the quantity of liquid film, the $O_2$ sensor information for knowing the effect of control input can not immediately appear because of a rotary period of a cylinder, a flow delay in an exhaust pipe, etc. That is, the object to be controlled in engine fuel may include a delay time. Further, this delay time is not constant but may change depending on the engine revolution speed. Therefore, there is a further problem that the air fuel information obtained by the $O_2$ sensor is made unclean by disturbance, noises, measurement error, etc., in the process of measurement.

In order to properly control an engine fuel control system which may include such a delay time, the present invention employs a method in which control is performed while predicting a liquid film which shows the internal state of the fuel control system. Further, as to the problem of the variations in such a delay time, the information during the largest delay time is accumulated and the delay time is calculated from the engine speed, to thereby predict the liquid film quantity during the delay time. Furthermore, as to the noises in the process of measurement by the $O_2$ sensor, an estimated optimum liquid film quantity is calculated by causing the output of the $O_2$ sensor to pass through a filter, by means of the least squares method.

BRIEF DESCRIPTION OF THE DRAWINGS

The present invention will be apparent from the following detailed description taken in conjunction with the accompanying drawings, in which.

DETAILED DESCRIPTION

Figure 1:
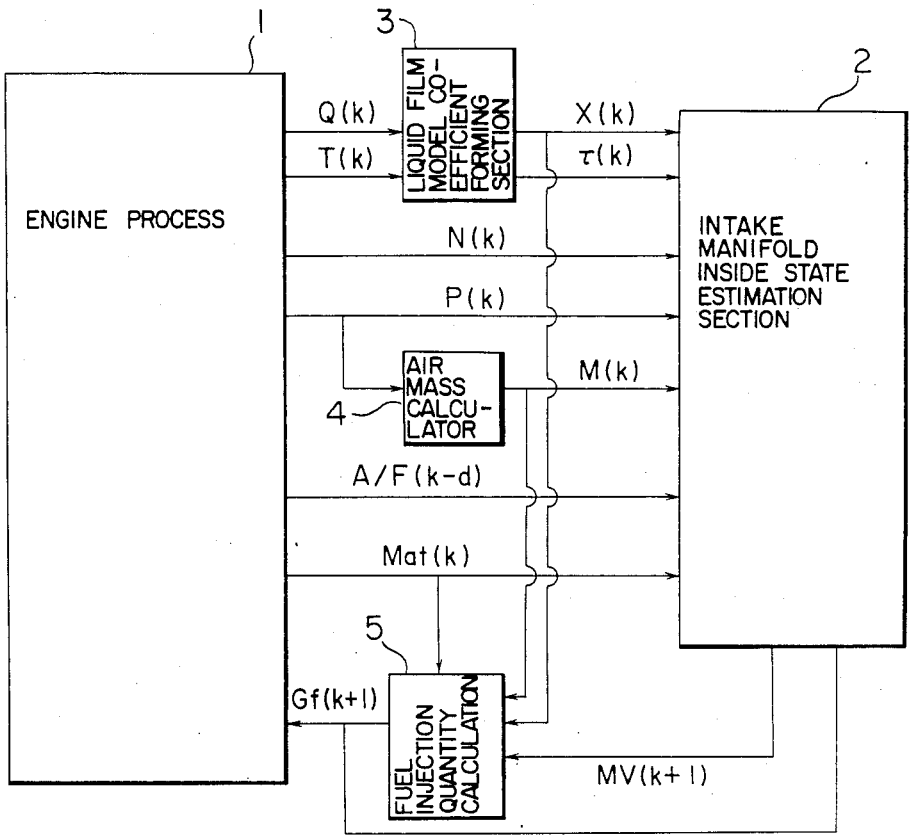
FIG. 1 is a schematic constituent diagram showing an embodiment of the control apparatus for controlling fuel injection according to the present invention.
Figure 2:
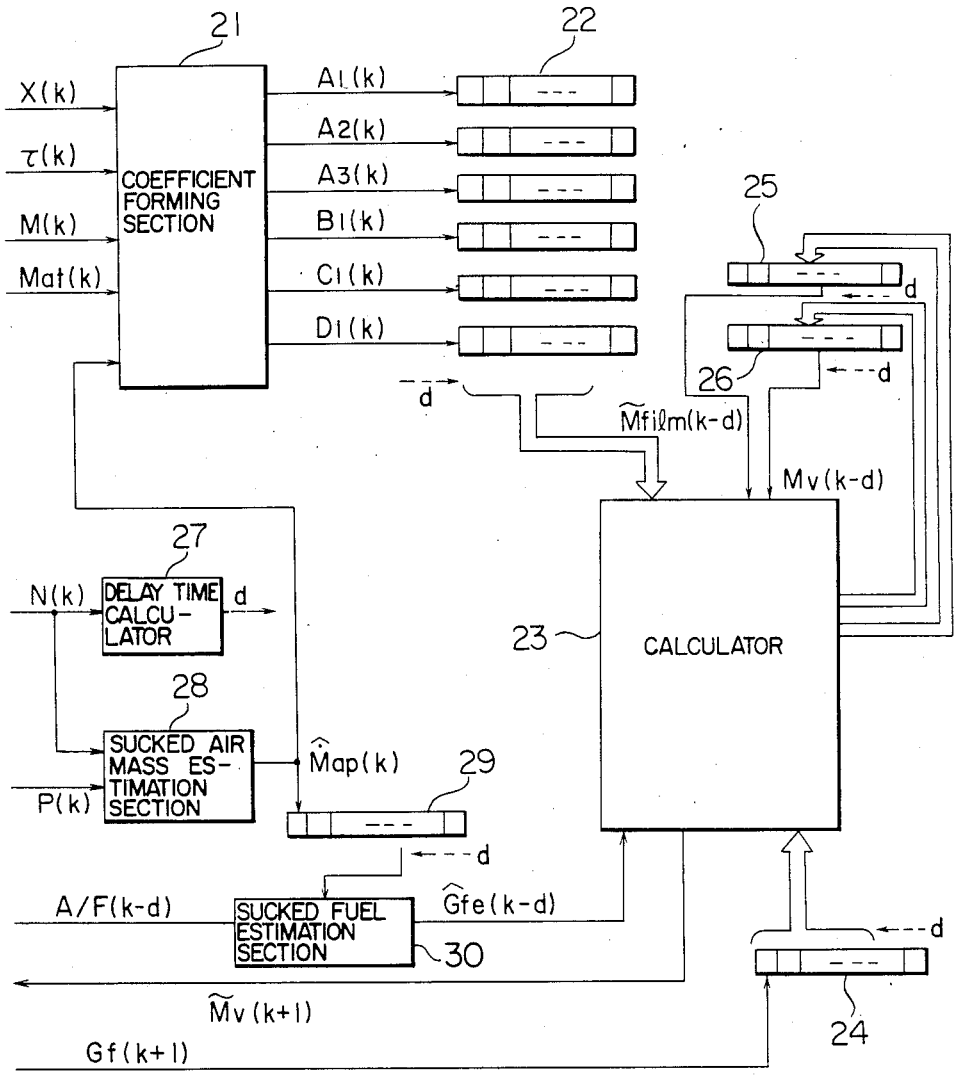
FIG. 2 is a schematic constituent diagram of the intake manifold inside state estimation section of FIG. 1.

Referring to FIGS. 1 and 2, an embodiment realizing the first feature of the present invention will be described hereunder. FIG. 1 shows an engine process 1 and an arrangement of fuel control in a computer. A liquid film model coefficient forming section 3 calculates a wall surface adhesion rate X and a liquid film evaporation time constant $\tau$ from the following equations (1) and (2):

$$X(k) = 0.3 + \frac{0.7}{90}\,\theta(k) \tag{1}$$

$$\tau(k) = \frac{60}{1.8 \times T(k) - 38} \tag{2}$$

where k represents a point time, $\theta$ throttle opening, and T temperature.

An intake manifold inside air mass calculator section 4 calculates air mass M in an intake manifold on the basis of the value of pressure in an intake manifold as follows:

$$M(k) = P(k)a_1 \tag{3}$$

where $a_1$ is a constant determined by the inside volume and temperature of the intake manifold.

Further, a fuel injection quantity calculator section 5 calculates the fuel injection quantity $G_f$ from the above-mentioned values X(k) and M(k), air mass $\dot{M}_{at}(k)$ flowing through a throttle valve obtained from the engine process 1, and a vapor fuel prediction value $\tilde{M}_v(k+1)$ which will be described later, in accordance with the following equation (4):

$$G_f(k+1) = \frac{\dfrac{\dot{M}_{at}(k)}{(A/F)} - \dfrac{\dot{M}_{at}(k)}{M(k)}\,\tilde{M}_v(k+1)}{(1 - X(k))} \tag{4}$$

where (A/F) represents a desired air fuel ratio. An intake manifold inside state estimation section 2 estimates and predicts the quantity of liquid film, vapor fuel, or the like, as the state variable the intake manifold, on the basis of the liquid film adhesion rate X and the evaporation time constant $\tau$ which are obtained from the liquid film model coefficient forming section 3, the intake manifold inside air mass M which is obtained from the air mass calculator section 4, and the air mass $\dot{M}_{at}(k)$ flowing through the throttle portion, the engine speed N, the intake manifold pressure P, and the air fuel ratio A/F which are obtained from the engine process 1, so as to produce the fuel injection quantity $G_f$ and apply it into the fuel quantity calculator section 5, in the embodiment shown in FIG. 1.

Referring to FIG. 2, the arrangement and operation of the intake manifold inside state estimation section 2 will be described. Air mass $\dot{M}_{ap}$ sucked into a cylinder is obtained by a sucked air mass estimation section 28 of FIG. 2 in accordance with the following equation (5):

$$\tilde{M}_{ap}(k) = P(k) \cdot \frac{N(k)}{60} \cdot a_2 \tag{5}$$

where $a_2$ is a constant determined by an engine exhaust quantity and a gas constant.

The thus obtained air mass $M_{ap}(k)$ is applied to a shift register 29 of FIG. 2 to shift the contents thereof right-hand, and stored in the rearmost end portion. A coefficient forming circuit 21 of FIG. 2 forms coefficients of a model for estimating and predicting the inside state of the intake manifold on the basis of the above-mentioned values X(k), $\tau$(k), M(k) and $\dot{M}_{at}(k)$ in accordance with the following expressions (6)–(11):

$$A_1(k) = e^{-\frac{1}{\tau(k)}\Delta T} \tag{6}$$

$$A_3(k) = e^{-\frac{\tilde{M}_{ap}(k)}{M(k)} \cdot \Delta T} \tag{7}$$

$$A_2(k) = \frac{M(k)}{\tilde{M}_{ap}(k)}\,\frac{1}{\tau(k)}\,[1 - A_3(k)] \tag{8}$$

$$B_1(k) = X(k)\tau(k)[1 - A_1(k)] \tag{9}$$

$$C_1(k) = \frac{\tilde{M}_{ap}(k)}{M(k)} \tag{10}$$

$$D_1(k) = (1 - X(k))\,\frac{\tilde{M}_{ap}(k)}{\dot{M}_{at}(k)} \tag{11}$$

where $\Delta T$ represents a sampling period. The coefficients $A_1(k)$, $A_2(k)$, $A_3(k)$, $B_1(k)$, $C_1(k)$ and $D_1(k)$ obtained in the coefficient forming circuit 21 of FIG. 2 are stored respectively in memory tables 22 of FIG. 2, the contents or data previously stored in the memory tables being thereby shifted to the right.

Similar to the memory tables 22, the fuel injection quantity obtained from the calculator section 5 of FIG. 1 is stored in a memory table 24 at the rearmost portion thereof, while shifting the previously stored data right.

The data as to the air fuel ratio obtained by the $O_2$ sensor has an exhaust gas flow delay in an exhaust pipe and this delay may change depending on the engine speed. A delay time calculator circuit 27 of FIG. 2 calculates the observation delay time d of the air fuel ratio data, in accordance with the following expression (12):

$$d = \left[\frac{120}{N(k)} \cdot \frac{1}{\Delta T}\right] \tag{12}$$

The value d is an integral multiple of the sampling period. The symbol [ ] in the expression 12 represents a function to make a numerical value an integral one. By using the thus obtained delay time d, the data as to the air fuel ratio obtained at a point of time k can be expressed by A/F(k−d) because the value of air fuel ratio obtained at the point of time k represents the value of the same at point of time (k−d) which is earier by d than the point of time k. An estimated value of fuel sucked into the cylinder at the point of time (k−d) is obtained in a sucked fuel estimation section 30 from the value A/F(k−d) and the value $\dot{M}_{ap}(k-d)$ stored in the memory table 29, in accordance with the following expression (13):

$$G_{fe}(k-d) = \frac{\dot{M}_{ap}(k-d)}{A/F(k-d)} \tag{13}$$

By using the thus obtained delay time d, a calculator circuit 23 of FIG. 2 estimates and predicts the liquid film and vapor fuel, as follows, from the above-mentioned value $G_{fe}(k-d)$; the information $A_1(k-d)$, $A_2(k-d)$, $A_3(k-d)$, $B_1(k-d)$, $C_1(k-d)$, and $D_1(k-d)$ respectively derived from the values $A_1(k)$, $A_2(k)$, $A_3(k)$, $B_1(k)$, $C_1(k)$, and $D_1(k)$ obtained from the memory table 22; the information $G_f(k-d)$ derived from the information $G_f(k)$ obtained from the memory table 24; and the information $\widetilde{M}_{film}(k-d)$ and $M_v(k-d)$ which are obtained from memory tables 25 and 26 as will be described later. For the sake of simplicity, applying the following expressions (14)–(17), an expression (18) representing the estimated states as to the liquid film and vapor fuel will be obtained as shown in the expression 18.

$$\widehat{X}(.) = \begin{pmatrix} \widehat{M}_{film}(.) \\ \widetilde{M}_v(.) \end{pmatrix}, \widetilde{X}(.) = \begin{pmatrix} \widetilde{M}_{film}(.) \\ \widetilde{M}_v(.) \end{pmatrix} \tag{14}$$

$$A(.) = \begin{pmatrix} A_1(.) & 0 \\ A_2(.) & A_3(.) \end{pmatrix} \tag{15}$$

$$B(.) = \begin{pmatrix} B_1(.) \\ 0 \end{pmatrix} \tag{16}$$

$$C^T(.) = [0 C_1(.)] \tag{17}$$

where the symbol · in (·) represents a point of time.

$$\widehat{X}(k-d) = \widetilde{X}(k-d) + \frac{FC(k-d)}{\sigma_e^2 + C^T(k-d)FC(k-d)} \times [\widehat{G}_{fe}(k-d) - C^T(k-d)\widetilde{X}(k-d) + D_1(k-d)G_f(k-d)] \tag{18}$$

where $$X(k-d) = \begin{pmatrix} \widetilde{M}_{film}(k-d) \\ \widetilde{M}_v(k-d) \end{pmatrix}$$

represents the estimated quantity of liquid film and the estimated vapor fuel, at the time (k−d); F represents an estimated error variance matrix; and $\sigma_e^2$ represents a variance of observation noises.

$$\left.\begin{aligned} &\widetilde{X}(k-d+1) = A(k-d)\widehat{X}(k-d) + \\ &B(k-d)G_f(k-d) \\ &\widetilde{X}(k-d+2) = A(k-d+1)\widetilde{X}(k=d+1) \\ &B(k-d+1)G_f(k-d-1) \end{aligned}\right\} \tag{19}$$

$$\widetilde{X}(k+1) = A(k)\widetilde{X}(k) + B(k)G_f(k) \tag{20}$$

Thus, the estimated values of liquid film and vapor fuel, which represent the state of the intake manifold at a point of time (k+1), can be derived.

Figure 5:
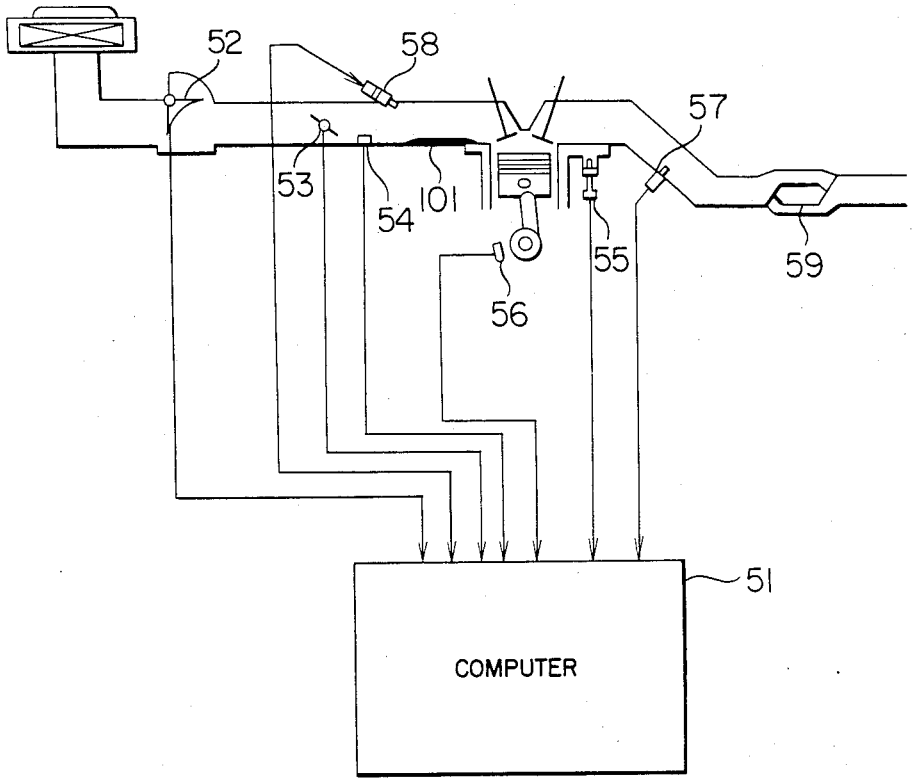
FIG. 5 is a schematic constituent diagram of a device associated with the fuel injection control section.

The estimated value of vapor fuel obtained by the expression (20) is applied to the circuit of FIG. 5. The respective values $M_{film}(k)$ and $M_v(k)$ derived from the values $M_{film}(k-d+1)$ and $M_v(k-d+1)$ obtained in the expression (19) are stored in the memory tables 25 and 26, respectively.

According to the embodiment described above, the quantity of liquid film and vapor fuel are estimated and predicted taking into consideration the change in delay time of the $O_2$ sensor depending on the change in engine speed, and the fuel injection quantity is controlled on the basis of the predicted vapor fuel, thereby holding the air fuel ratio approximately at a desired air fuel ratio. In this way, it becomes possible to reduce harmful exhaust gases.

Next, referring to FIGS. 5, 6, and 7, another embodiment for realizing the second feature of the invention will be described hereunder. FIG. 5 is a constituent diagram of a device associated with the fuel injection control section. Air mass $\dot{M}_{at}$ flowing through a throttle portion is detected by an air flow meter 52 and applied to a computer 51. Similarly to this, throttle opening $\theta$, pressure inside an intake manifold, water temperature T, engine speed N, and air fuel ratio A/F are respectively obtained by a throttle sensor 53, a negative pressure sensor 54, a water temperature sensor 55, and a crank angle sensor 56 (through a tachometer generator), and applied to the computer 51. The computer 51 supplies a command of the quantity of fuel injection to an injector 58. The reference numeral 101 represents a liquid film.

Figure 6:
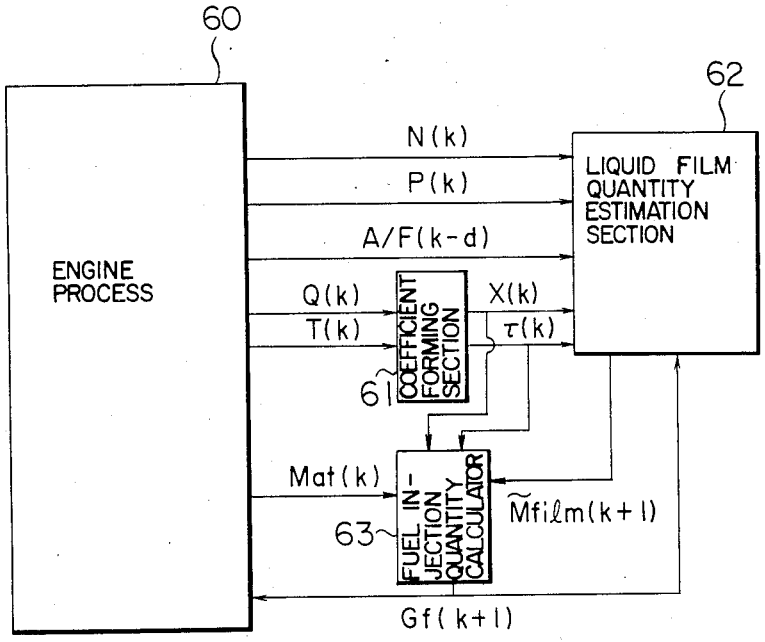
FIG. 6 is a schematic constituent diagram for explaining the control operation of the fuel injection control section of FIG. 5.

FIG. 6 is a block diagram showing the contents of processing of fuel injection control in the computer 51. A liquid film model coefficient forming section 61 calculates a wall surface adhesion rate X and a liquid film evaporation time constant $\tau$. Here, by way of example, the adhesion rate X and the time constant $\tau$ as functions of throttle opening and temperature, respectively, are shown as follows:

$$X(k) = 0.3 + \frac{0.7}{90}\theta(k) \tag{21}$$

$$\tau(k) = \frac{60}{1.8 \times T(k) - 38} \tag{22}$$

where k represents a point of time. The calculated wall surface adhesion rate X(k) and the liquid film evaporation time constant $\tau(k)$ are applied to a liquid film estimation section 62 together with an engine speed N(k), pressure P(k), and an air fuel ratio A/F(k−d) supplied from an engine process 60, and a fuel injection quantity $G_f(k+1)$ calculated in a fuel injection quantity calculator section 63 which will be described later. The fuel injection quantity calculator section 63 calculates a fuel injection quantity $G_f(k+1)$ in accordance with the following expression (23), on the basis of the above-mentioned values X(k) and $\tau$(k), a value of air mass $M_{at}$(k) flowing through the throttle section, and a predicted value of liquid film quantity $M_{film}$(k+1) calculated by the liquid film estimation section 62:

$$G_f(k+1) = \frac{\frac{\dot{M}_{at}(k)}{(A/F)} - \frac{\tilde{M}_{film}(k+1)}{\tau(k)}}{(1 - X(k))} \tag{23}$$

where (A/F) represents a desired air fuel ratio.

Figure 7:
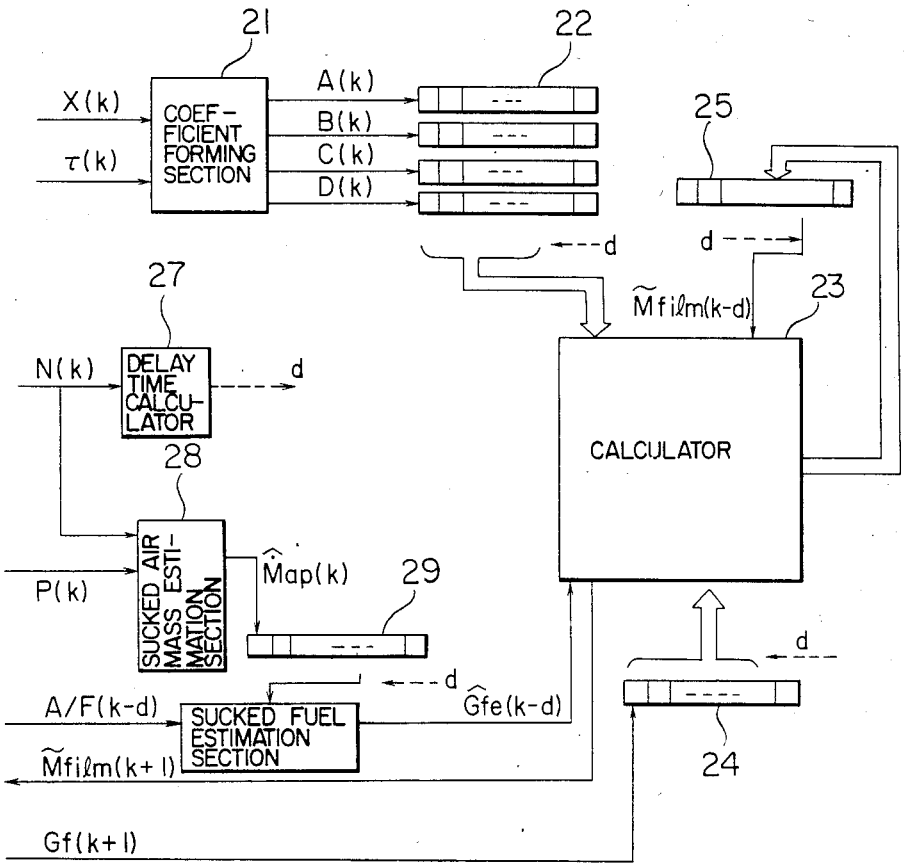
FIG. 7 is a schematic constituent diagram showing the liquid quantity estimation section 62 in FIG. 6.

Referring to FIG. 7, the arrangement and operation of the liquid film quantity estimation section 62 will be described hereunder. Items in FIG. 7 similar to items in FIG. 2 are correspondingly referenced. In order to make the liquid film model be in a discrete time system, a coefficient forming circuit 21 of FIG. 7 converts the coefficients of the liquid film model from a continuous time system into a discrete time system, on the basis of the values X(k) and $\tau$(k) obtained in the liquid film model coefficient forming section 61 of FIG. 6.

$$\left.\begin{aligned} A(k) &= e^{-\frac{1}{\tau(k)}\Delta T} \\ B(k) &= X(k)\tau(k)\left(1 - e^{-\frac{1}{\tau(k)}\Delta T}\right) \\ C(k) &= \frac{1}{\tau(k)} \\ D(k) &= (1 - X(k)) \end{aligned}\right\} \tag{24}$$

where $\Delta$T represents a sampling period (the sampling period being assumed to be equal to a time interval of calculation, here) which corresponds to a time interval from a point of time (k−1) to a point of time (k) with respect to a desired point of time k. The thus obtained coefficients A(k), B(k), C(k) and D(k) obtained in the coefficient forming circuit 21 of FIG. 7 are stored into memory tables 22 in the following manner. That is, assuming the actual point of time k, the coefficients A(k), B(k), C(k), and D(k) are applied to the rearmost ends of the respective memory tables 22, while shifted the previously shifting data to the right in the respective memory tables 22. The length of each of the memory tables is selected to be 11 here.

Next, a suction air mass estimation section 28 for estimating air mass $\dot{M}_{ap}$ sucked into a cylinder estimates a value $\dot{M}_{ap}$(k) on the basis of the information P(k) and N(k) obtained from a pressure sensor and a tachometer generator respectively, in accordance with the above-mentioned expression (5).

The value $\dot{M}_{ap}$(k) obtained in the suction air mass estimation section 28 is applied to a memory table 29 at its rearmost end while shifting the previously stored data right, similarly to the case of the memory tables 22.

The fuel injection quantity at the point of time k obtained in the fuel injection quantity calculator section 63 of FIG. 6 is applied to a memory table 24 at the rearmost end thereof while shifting the previously stored contents to the right, similarly to the case of the memory tables 22.

The information of air fuel ratio obtained from the $O_2$ sensor has an observation delay due to the flow delay of exhaust gas in an exhaust pipe. Further, this delay time is not constant but changes depending on the engine speed. Accordingly, description will be made as to the calculation in which the delay time is calculated from the engine speed, the past liquid film quantity is estimated from the information associated with the delay time obtained from the memory tables 22, 29 and 24 and a memory table 25 which will be described later, and the liquid film quantity at the point of time (k+1) is predicted. A delay time calculator circuit 27 of FIG. 7 calculates the delay time d in accordance with the above-mentioned expression (12). By using the thus obtained delay time d, actual information obtained by the $O_2$ sensor can be expressed as A/F(k−d) because it represents the air flow ratio before the time d. On the basis of the air fuel ratio A/F(k−d) and the value $\dot{M}_{ap}$(k−d) stored in the memory table 29, the estimated value $\hat{G}_{fe}$(k−d) of fuel sucked into the cylinder before the time d is obtained in a sucked fuel estimation section 30 of FIG. 7, in accordance with the above-mentioned expression (13).

Next, a calculator circuit 23 of FIG. 7 estimates and predicts the liquid film as follows; on the basis of the thus obtained $\hat{G}_{fe}$(k−d); the information of A(k−d), B(k−d), C(k−d) and D(k−d) respectively derived from the values A(k), B(k), C(k) and D(k) obtained from the memory tables 22; the information $G_f$(k−d) derived from the value $G_f$(k) obtained from the memory table 24; and the information $M_{film}$(k−d) obtained from the memory table 25 which will be described later.

$$\tilde{M}_{film}(k-d) = \tilde{M}_{film}(k-d) + \frac{Fc(k-d)}{\sigma_e^2 + c(k-d)Fc(k-d)} \times [\hat{G}_{fe}(k-d) - c(k-d)\tilde{M}_{film}(k-d) + D(k-d)G_f(k-d)] \tag{25}$$

where $\tilde{M}_{film}$(k−d) represents the estimated liquid film quantity at the point of time (k−d), F represents the estimated error variance, and $\sigma_e^2$ represents the variance of observation noises.

$$\left.\begin{aligned} &\tilde{M}_{film}(k-d+1) = A(k-d)\tilde{M}_{film}(k-d) + B(k-d)G_f(k-d) \\ &\tilde{M}_{film}(k-d+2) = A(k-d+1)\tilde{M}_{film}(k-d+1) + B(k-d+1)G_f(k-d+1) \\ &\tilde{M}_{film}(k) = A(k-1)\tilde{M}_{film}(k-1) + B(k-1)G_f(k-1) \end{aligned}\right\} \tag{26}$$

$$\tilde{M}_{film}(k+1) = A(k)\tilde{M}_{film}(k) + B(k)G_f(k) \tag{27}$$

The estimated liquid film quantity obtained by the equation (26) is applied to the fuel injection quantity calculator section 63 of FIG. 6, and the values $\tilde{M}_{film}$(k−d+1) to $\tilde{M}_{film}$(k) are stored in the memory table 25 successively from left in the order $M_{film}$(k) . . . $M_{film}$(k−d+1), the data prior to the value $M_{film}$(k−d) being shifted right in the memory table 25.

According to this embodiment, the liquid film quantity is estimated and predicted taking into consideration the change of useless time of the $O_2$ sensor which changes depending on the engine speed, and the fuel injection quantity is controlled on the basis of the thus estimated and predicted liquid film quantity, thereby holding the air fuel ratio at a value approximate to a desired air fuel one. In this way, it becomes possible to reduce harmful exhaust gases.

Figure 3:
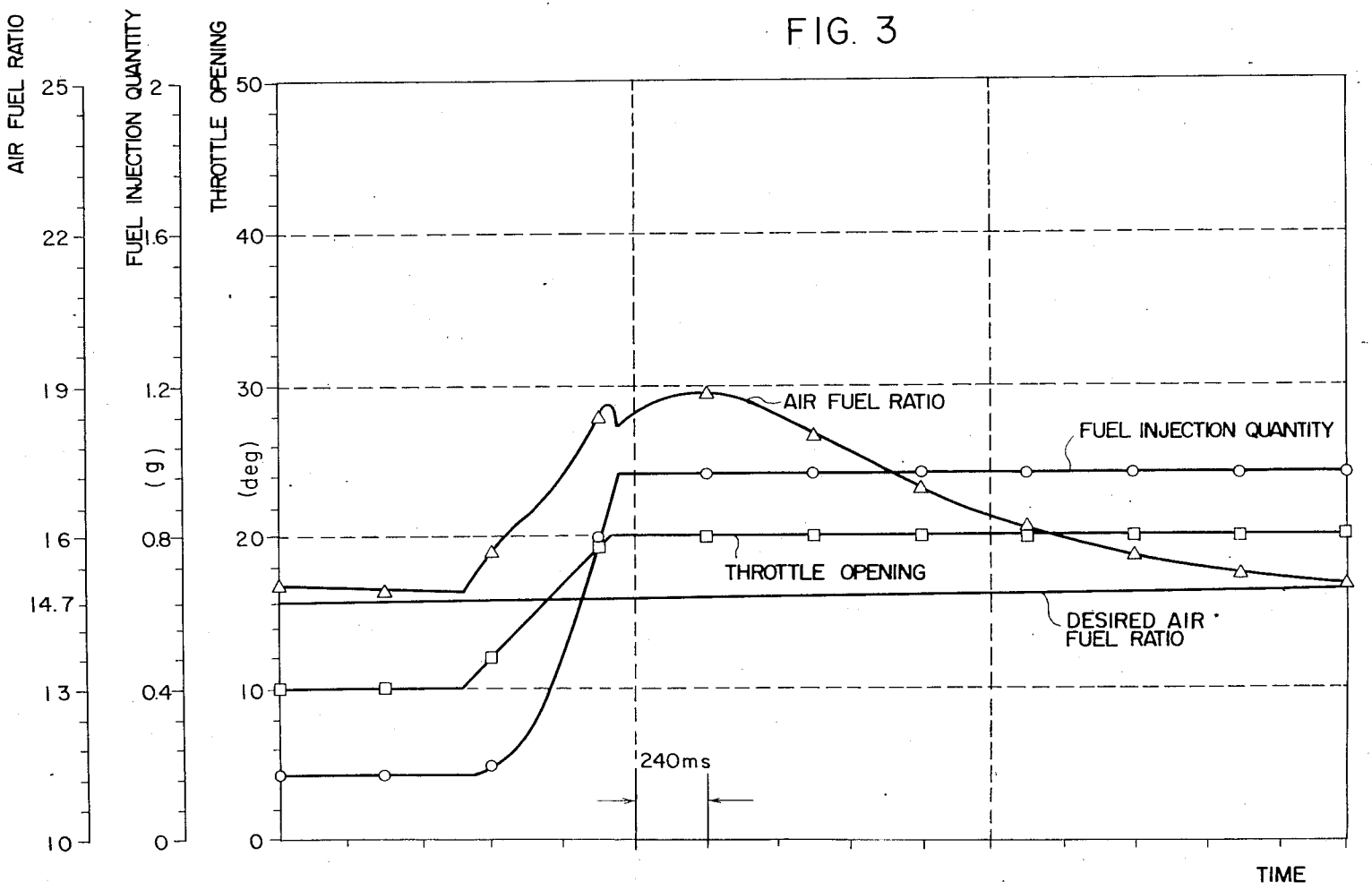
FIG. 3 is a diagram showing a conventional example of the relationship of the air fuel ratio and fuel injection quantity with respect to the variations in throttle opening.
Figure 4:
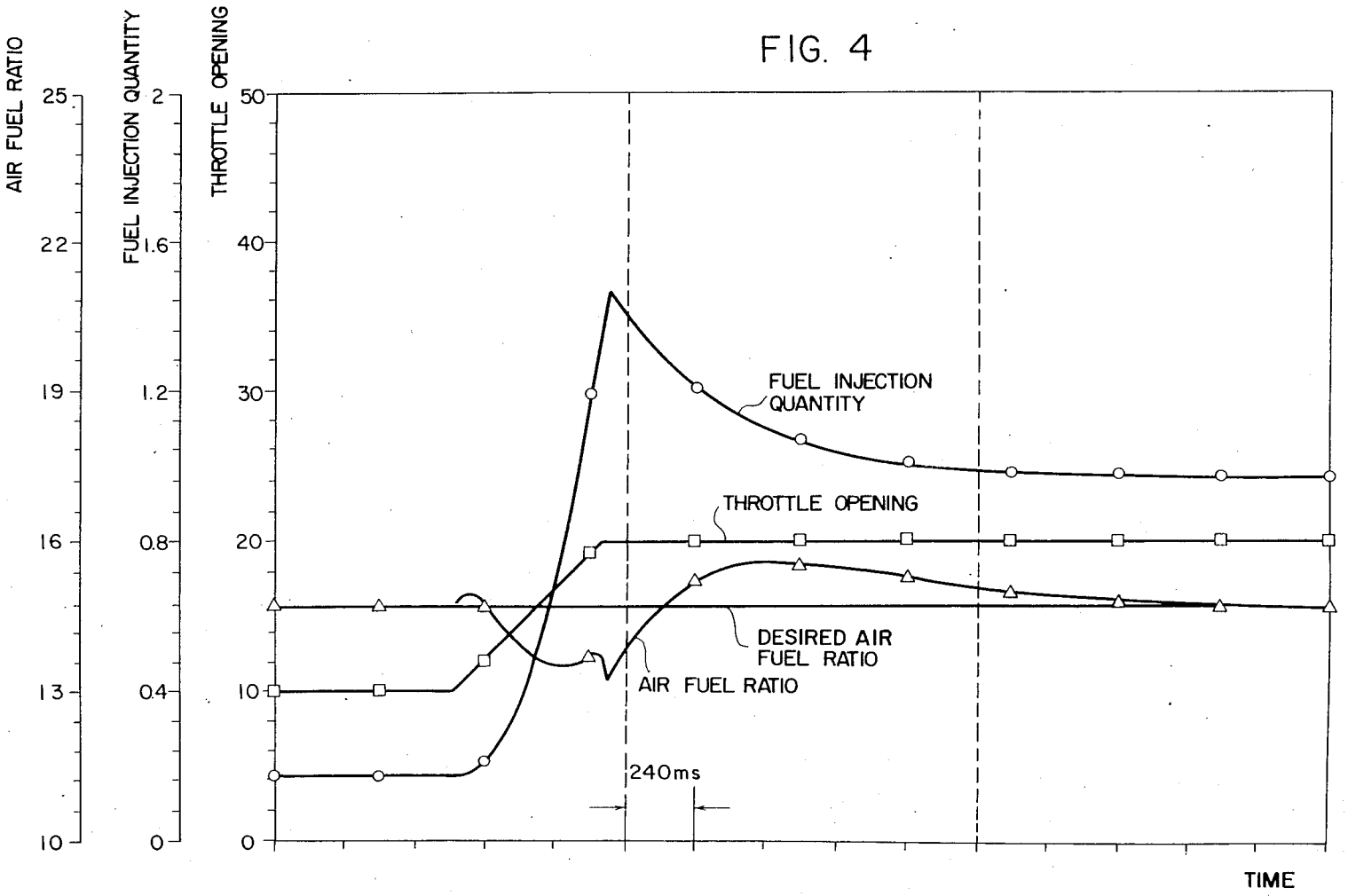
FIG. 4 is a diagram showing the relationship of the air fuel ratio and fuel injection quantity with respect to the throttle opening, according to the present invention.
Figure 8:
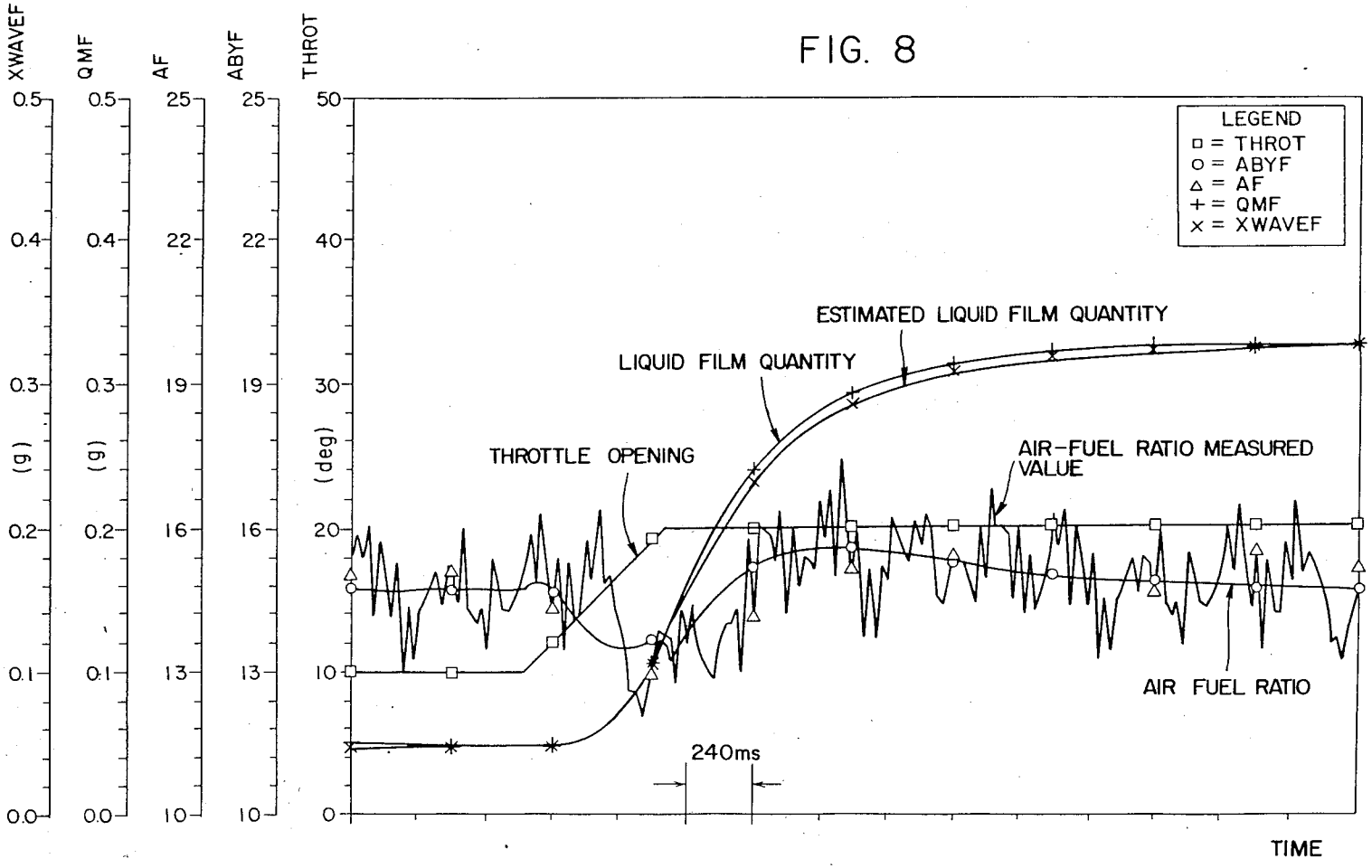
FIG. 8 is a diagram showing the relationship of the air fuel ratio, the predicted quantity of the air fuel ratio, the liquid film quantity, and the predicted value of the liquid film quantity, relative to the change in throttle opening.

As described above, the present invention has an effect to reduce harmful gases because it is possible to hold the air fuel ratio at a value approximate to a desired air fuel ratio. Referring to FIGS. 3, 4, and 8, the effect of the present invention will be described. FIG. 3 is a graph of an example of the conventional case, showing the air fuel ratio and fuel injection quantity which enter a cylinder when the throttle opening is changed from 10° to 20° for 0.5 seconds (corresponding to acceleration). As seen in FIG. 3, during acceleration, the increase in fuel quantity is small relative to the increase in air quantity entering the cylinder so that the air fuel ratio is higher than the desired air fuel ratio 14.7. From this, it is understood that a large quantity of harmful gas NOx is produced. FIG. 4 shows an example of the control performance according to the present invention, in which there are shown the air fuel ratio and the fuel injection quantity entering the cylinder under the same conditions as shown in FIG. 3. As seen from FIG. 4, control is made such that the fuel injection quantity is made larger as the throttle opening changes while reduced upon stopping the change in throttle opening. Thus, it is possible to hold the air fuel ratio to a value approximate to a desired air fuel ratio to thereby reduce harmful exhaust gases. FIG. 8 shows the air fuel ratios entering the cylinder and obtained by the $O_2$ sensor respectively, and the liquid film quantity adhered on the intake manifold and the estimated value of the same. The air fuel ratio obtained by the $O_2$ sensor is made unclear by noises, the characteristic of the sensor, etc., and, further, includes a useless time. As seen in FIG. 8, the function for predicting the liquid film quantity is operating effectively, even if such a delay time, noises, or the like, is included in the information from the $O_2$ sensor.

We claim:

1. In an engine control apparatus for controlling a fuel injection quantity for an engine, a method for controlling fuel injection for the engine the method comprising the steps of:

estimating, at a first prescribed point in time, the quantity of a liquid film which is part of injection fuel adhering to a wall surface of a fuel intake manifold and the quantity of a part of fuel vaporized from the liquid film and remaining in said intake manifold without being sucked into a cylinder;

predicting the quantity of the liquid film and the quantity of vapor fuel at a second prescribed point in time, subsequent to said first prescribed point in time;

modifying said predicted quantities on the basis of a resultant value of an estimation obtained in the estimating step and by using a fuel system model including an air fuel ratio as a control parameter; and controlling the quantity of fuel injection at said first prescribed point in time so as to make the air fuel ratio at said second prescribed point in time be a desired air fuel ratio.

2. In an engine control apparatus for controlling a fuel injection quantity for an engine, a method for controlling fuel injection for the engine, the method comprising the steps of:

estimating the quantity of a liquid film which is a part of injected fuel adhering to a wall surface of a fuel intake manifold at a first prescribed point in time;

predicting a sum of the quantity of fuel vaporized from the liquid film and the quantity of fuel which is part of the injected fuel and does not adhere to the intake manifold wall surface at a second prescribed point in time, subsequent to said first prescribed point in time, on the basis of a resultant value of an estimation obtained in the estimating step and by using, as control parameters, a fuel system model including engine speed and air fuel ratio obtained by way of an observation value from a sensor having an observation delay time; and controlling the quantity of fuel injection at said first prescribed point in time so as to make the air fuel ratio at said second prescribed point in time equal to a desired air fuel ratio, on the assumption that the quantity of fuel corresponding to the predicted sum is sucked into a cylinder.

3. A method for controlling fuel injection for the engine according to claim 2, in which the observation delay time is calculated from the engine speed.

4. A method for controlling fuel injection for the engine according to claim 2, in which a plurality of pieces of information of air fuel ratio corresponding to a plurality of delay times are stored in a memory in advance, and when a delay time is calculated, one of said plurality of pieces of information of air fuel ratio corresponding to the calculated delay time is read out of said memory as the air fuel ratio at a point in time earlier by said delay time.

5. A method for controlling fuel injection for the engine according to claim 2, further comprising the step of removing noise from a measurement signal obtained by said sensor.

* * * * *